US008030603B2

(12) United States Patent
Schroeder

(10) Patent No.: US 8,030,603 B2
(45) Date of Patent: Oct. 4, 2011

(54) SYSTEMS AND METHODS FOR A SELECTIVELY ENGAGEABLE SHAFT LOCK AND DRIVE DEVICE PRIORITY

(75) Inventor: Richard W. Schroeder, Healdsburg, CA (US)

(73) Assignee: General Dynamics Ordinance and Tactical Systems, Inc., St. Petersburg, FL (US)

( * ) Notice: Subject to any disclaimer, the term of this patent is extended or adjusted under 35 U.S.C. 154(b) by 414 days.

(21) Appl. No.: 12/422,673

(22) Filed: Apr. 13, 2009

(65) Prior Publication Data

US 2009/0255355 A1 Oct. 15, 2009

Related U.S. Application Data

(60) Provisional application No. 61/044,351, filed on Apr. 11, 2008.

(51) Int. Cl.
*F42B 15/01* (2006.01)

(52) U.S. Cl. ..... 244/3.24

(58) Field of Classification Search ..... 244/3.24, 244/3.26, 3.27, 3.28, 3.29; 70/188, 189, 70/422, 379 R, 379 A, 380, 277, 223; 292/22, 292/39, 57, 160, 279; 192/69.8–69.83, 89.27, 192/114 R See application file for complete search history.

(56) References Cited

U.S. PATENT DOCUMENTS

2002/0007688 A1* 1/2002 Punko ..... 74/405
2004/0237608 A1* 12/2004 Chen ..... 70/224

* cited by examiner

*Primary Examiner* — Timothy D. Collins
*Assistant Examiner* — Nicholas McFall
(74) *Attorney, Agent, or Firm* — Harvey S. Kauget; Phelps Dunbar LLP

(57) ABSTRACT

The present invention provides an apparatus and methods directed to a selectively engageable shaft locking device. In one embodiment, a shaft lock device is presented which enables the testing of the shaft and shaft drive device without engaging the drive mechanism into a fully operational state. Another embodiment provides the ability to return the shaft lock device to a storage state after full engagement. The present invention also provides for methods of testing a selective shaft lock device according to the disclosures contained herein.

24 Claims, 5 Drawing Sheets

SYSTEMS AND METHODS FOR A SELECTIVELY ENGAGEABLE SHAFT LOCK AND DRIVE DEVICE PRIORITY

PRIORITY

This application claims priority to U.S. Provisional Patent Application No. 61/044,351 filed Apr. 11, 2008 entitled "Selectively Engageable Shaft Lock and Drive Device." This provisional patent application is incorporated herein by reference.

FIELD OF THE INVENTION

The present invention relates to an improved shaft lock and drive device for use on aerodynamic surfaces.

BACKGROUND OF THE INVENTION

The present invention relates to a selectively engageable shaft lock and drive device which can be used in applications such as steerable aerodynamic surfaces on rockets, missiles, bombs or the like. Typical shaft lock and drive devices in use have two states: a "storage" state in which the shaft and drive mechanism is locked in place and an "in use" state where the shaft lock is disengaged and the drive device operates to control the shaft and, in turn the connected aerodynamic surface. In typical shaft lock and drive devices currently in use, once the shaft lock is disengaged it cannot be returned to the "storage" or "engaged state." This is primarily due to the fact that current shaft lock and drive devices typically use pyrotechnic bolts, fasteners or the like to engage the shaft lock. Once the pyrotechnic bolts are destroyed (as the shaft lock is disengaged), the shaft lock can never return to the "storage" or "engaged" state.

Another problem addressed by the current invention relates to the inability of the prior art shaft lock and drive devices to be fully tested prior to deployment. The current invention provides for a reversible shaft lock and drive device which allows the drive device to be fully operated and tested while the rocket, missile, etc. is in a state other than flight.

Another purpose of this invention is to provide a single mechanism to both maintain the shaft lock in the engaged position and to drive the shaft once the rocket, missile, etc. is in flight. This results in a fundamental cost and weight savings versus a separately operated device, regardless of type (motor, pyrotechnic, gas generator, etc.).

BRIEF SUMMARY OF THE INVENTION

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

DETAILED DESCRIPTION OF THE INVENTION

Figure 1:
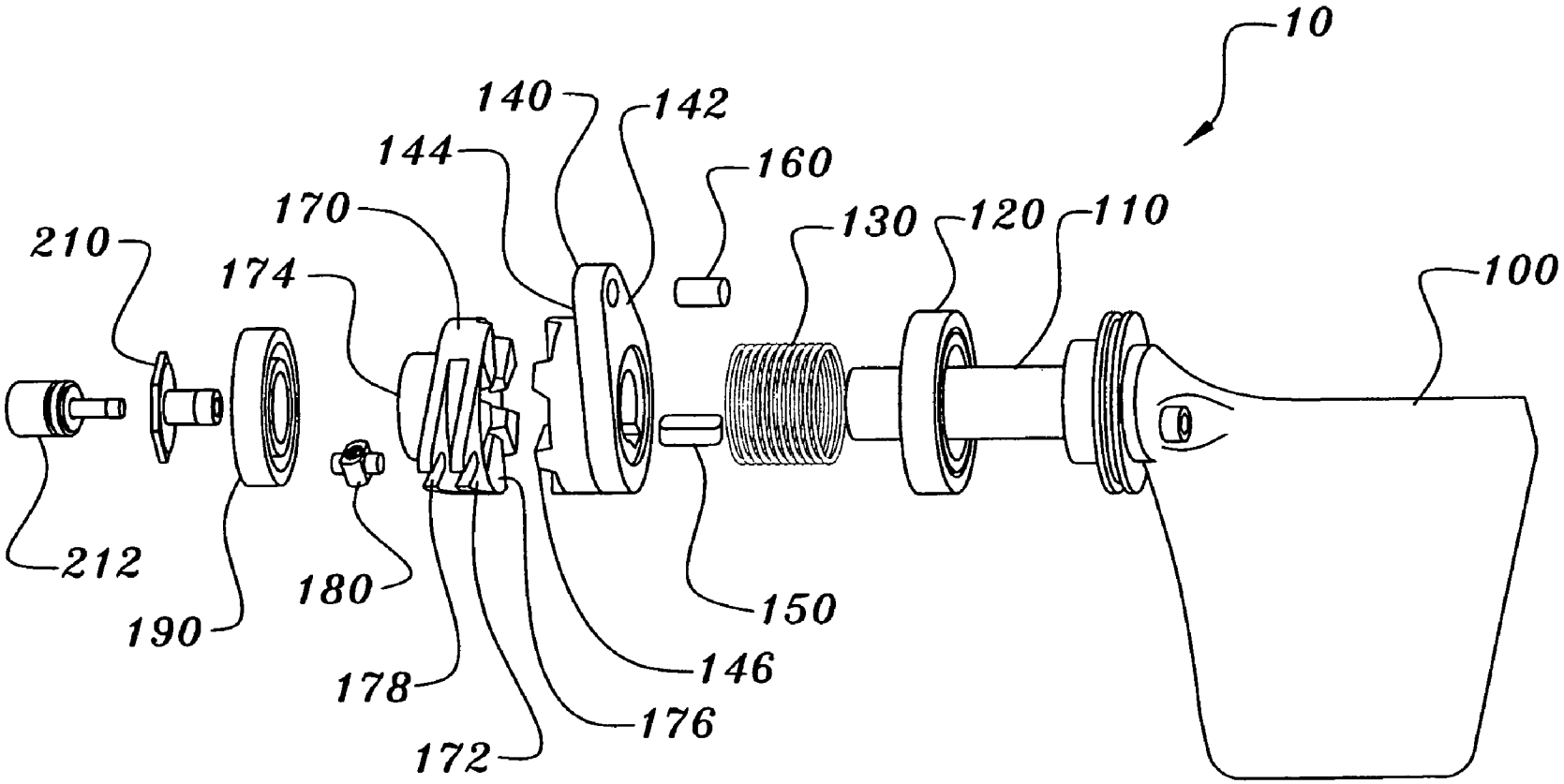
FIG. 1 illustrates an exploded view of an embodiment of the shaft lock device as contemplated by the present invention.

FIG. 1 illustrates an exploded view of a shaft lock device 10 according to the present invention. Fin 100 is attached to rotating fin shaft 110 such that a given rotation of shaft 110 causes fin 100 to rotate to a corresponding degree. Fixed buttress 120 is located in a fixed position along the axis of shaft 110 in order to provide a rigid surface against which stored energy device 130 can seat. In a preferred embodiment, fixed buttress 120 can have the shape of a ring, however other geometric shapes or devices (i.e., pins, etc.) are contemplated. Stored energy device 130 can be any type of mechanism capable of storing and releasing energy via compression, expansion or the like. In a preferred embodiment, stored energy device 130 is a spring. Slidable coupling 140 has a first major surface 142 and a second major surface 144. Slidable coupling 140 is located along shaft 110 such that stored energy device 130 is disposed between slidable coupling 140 and fixed buttress 120 in a manner that stored energy device 130 can exert force against the first major surface 142 of slidable coupling 140 in a direction parallel to shaft 110. Slidable coupling 140 is free to slide along shaft 110, however the axial rotation of slidable coupling is inhibited via rotation lock 150. Rotation lock 150 can be a spline, pin or other mechanism which engages with the first major surface 142 of slidable coupling 140 and fixed buttress 120 in order to retard the axial rotation of slidable coupling 140. This retardation of axial rotation has the effect of fixing slidable coupling 140 and fixed buttress 120 together such that any axial rotation of slidable coupling 140 necessarily would result in axial rotation of fixed buttress 120 and, correspondingly, shaft 110. It is also contemplated that rotation lock 150 can take the form of a keyway, i.e., an interlocking tongue-and-groove joint between shaft 110 and slidable coupling 140. In a preferred embodiment, rotation lock 150 is a pin. In another preferred embodiment, shaft 110 further contains a female dovetail groove which interlocks with a matching male dovetail cutout on slidable coupling 140 to prevent axial rotation. It is also contemplated to reverse the location of the male and female dovetail joints between shaft 110 and slidable coupling 140.

First major surface 142 of slidable coupling 140 further contains a selective axial rotation device 160. Selective axial rotation device 160 can be in the form of a pin, rod, bolt or any other such mechanism known to those skilled in the art. In a preferred embodiment, selective axial rotation device 160 is a pin. Selective axial rotation device 160 is fixedly mounted on the first major surface 142 of slidable coupling 140 and projects outward from first major surface 142 of slidable coupling 140 to engage with selective axial engagement port 162 (shown on FIG. 2) when the shaft lock device is in the "storage" state. Once the shaft lock device is moved to the "in use" state, slidable coupling 140 will move along shaft 110 a sufficient distance such that selective axial rotation device 160 is no longer engaged with selective axial engagement port 162. Selective axial engagement port 162 can be any hole, depression, etc. which is designed or otherwise able to accept selective axial rotation device 160 and retard the axial rotation of selective axial rotation device 160 when the shaft lock is in the "storage" state.

Figure 5:
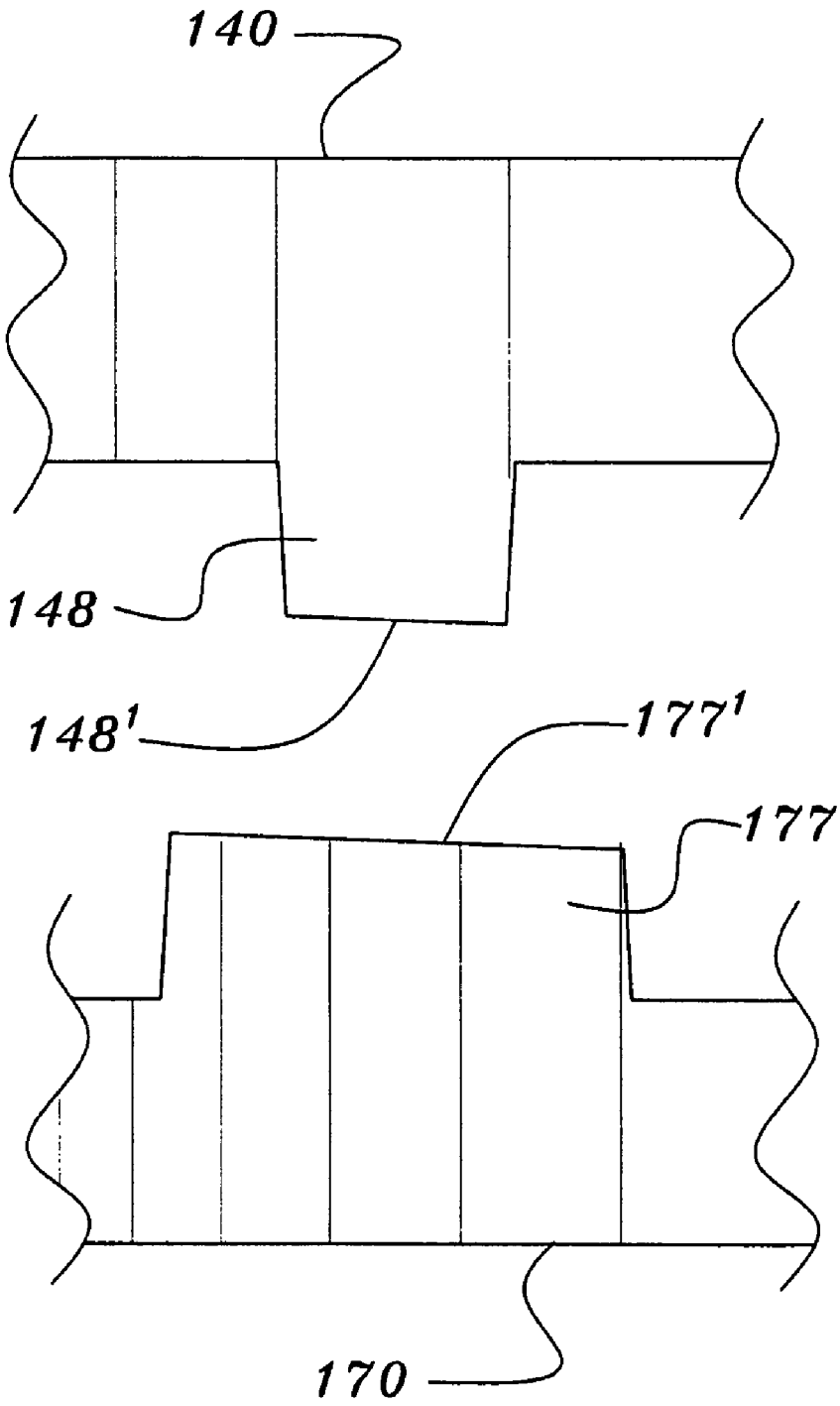
FIG. 5 illustrates a close up view of the engagement structures according to an embodiment of the present invention in the "storage" state.

Second major surface 144 of slidable coupling 140 contains engagement structure 146. Engagement structure 146 can be any type of mechanical engagement sufficient to permit the mating of slidable coupling 140 and rotatable coupling 170. In a preferred embodiment engagement structure 146 is a castle-nut design which has a number of teeth 148 (as shown in FIG. 5). Teeth 148 can be straight, flared or otherwise have an angled cross section in order to provide additional stability when engaged.

Rotatable coupling 170 has a first major surface 172 and a second major surface 174. Rotatable coupling 170 is disposed along shaft 110 but is free to rotate axially about shaft 110. First major surface 172 of rotatable coupling 170 contains engagement structure 176. Engagement structure 176 is design to be complimentary to engagement structure 146 located on slidable coupling 140 such that once engagement structure 146 and engagement structure 176 are mated, any axial rotation of rotatable coupling 170 is transferred to slidable coupling 140. In a preferred embodiment, engagement structure 176 is a "castle-nut" type design similar to that employed on slidable coupling 140. In a preferred embodiment, engagement structure 176 contains teeth 177 (shown in FIG. 5) which serve to engage with the opposing recessed areas between teeth 148 located on engagement structure 146. In another preferred embodiment, teeth 177 cover a majority of the area of first major surface 172, thus providing a limited area of "recessed" area between teeth 177. The limited amount of "recessed" area permits a greater range of motion of rotatable coupling 170 before engagement with slidable coupling 140 during a "test" as would be appreciated by one skilled in the art. In other words, by employing broad teeth 177 on rotatable coupling 170 and narrow teeth 148 on slidable coupling 140, actuator 200 (shown in FIG. 2) will be able to move rotatable coupling 170 via drive device 179 (shown in FIG. 2) through a limited degree of motion without causing slidable coupling 140 to engage with rotatable coupling 170. This built-in testing ability is specifically contemplated by the present invention.

It is also contemplated by the present invention for the top surface 148$^1$ of teeth 148 and the top surface 177$^1$ of teeth 177 to be angled (as illustrated in FIG. 5.) Top surface 148$^1$ and top surface 177$^1$ come into contact during the time the shaft lock is in the "storage" state. Because slidable coupling 140 is under tension from stored energy device 130, slidable coupling 140 can have a tendency to rotate under vibration when in the "storage" state. Thus, by providing an angle for top surface 148' and the corresponding top surface 177$^1$ along with broad teeth 177 on rotatable coupling 170, undesired rotation of the shaft lock device 10 under vibration when in "storage" can be achieved more successfully than if top surfaces 148$^1$ and 177$^1$ were flat. In a preferred embodiment, the direction of the angle of top surfaces 148$^1$ and 177$^1$ is selected such that the tension exerted by stored energy device 130 serves to force rotatable coupling 170 to rotate in the opposite direction as is necessary for engagement of the shaft lock device 10 into the 'in use' state.

Rotatable coupling 170 further contains an attachment port 178. Attachment port 178 can be a pin, bolt, hole, bracket or any other such mechanism which permits a drive device 179 to be engagably connected to rotatable coupling 170. Drive device 179 can be a screw, pin or any other drive mechanism know to those in the art which can be attached to an actuator motor, piston, etc. and transfer energy or force from the actuator itself to attachment port 178 and thus apply the energy or force to rotatable coupling 170 causing it to rotate about shaft 110. In the embodiment illustrated in FIG. 2, drive device 179 is a screw-threaded shaft. In a preferred embodiment, attachment coupling 180 is provided to facilitate the attachment of drive device 179 with actuator attachment port 178. A shown in FIG. 1, attachment coupling 180 is a threaded bolt machined to accept the insertion of drive device 179. Attachment coupling 180 can also be selected from any known configuration of mechanical connectors which would service to permit the engagement of drive device 179 with attachment port 178. Drive device 179 can be any structure suitable to transfer movement from an actuator to rotatable coupling 170. Linear actuators are contemplated by some embodiments of the present invention, however gear drives or any other known actuator can be employed.

Shaft lock device 10 further comprises a mounting device 190 which is fixedly attached to the support structure of the missile, rocket etc. Mounting device 190 is designed to permit second major surface 174 of rotatable coupling 170 to seat and remain rotatably in place. Axial pin 210 is fixedly mounted to the inside of rotatable coupling 170 along with potentiometer 212. Potentiometer 212 is used to gather and report rotational data concerning the position of rotatable coupling 170 while in storage, testing or flight. As illustrated in FIG. 1, potentiometer 212 is of a cartridge pot design as known to one skilled in the art, however all other types of position sensors which serve to provide rotational information as known to those in the art can be employed.

Figure 2:
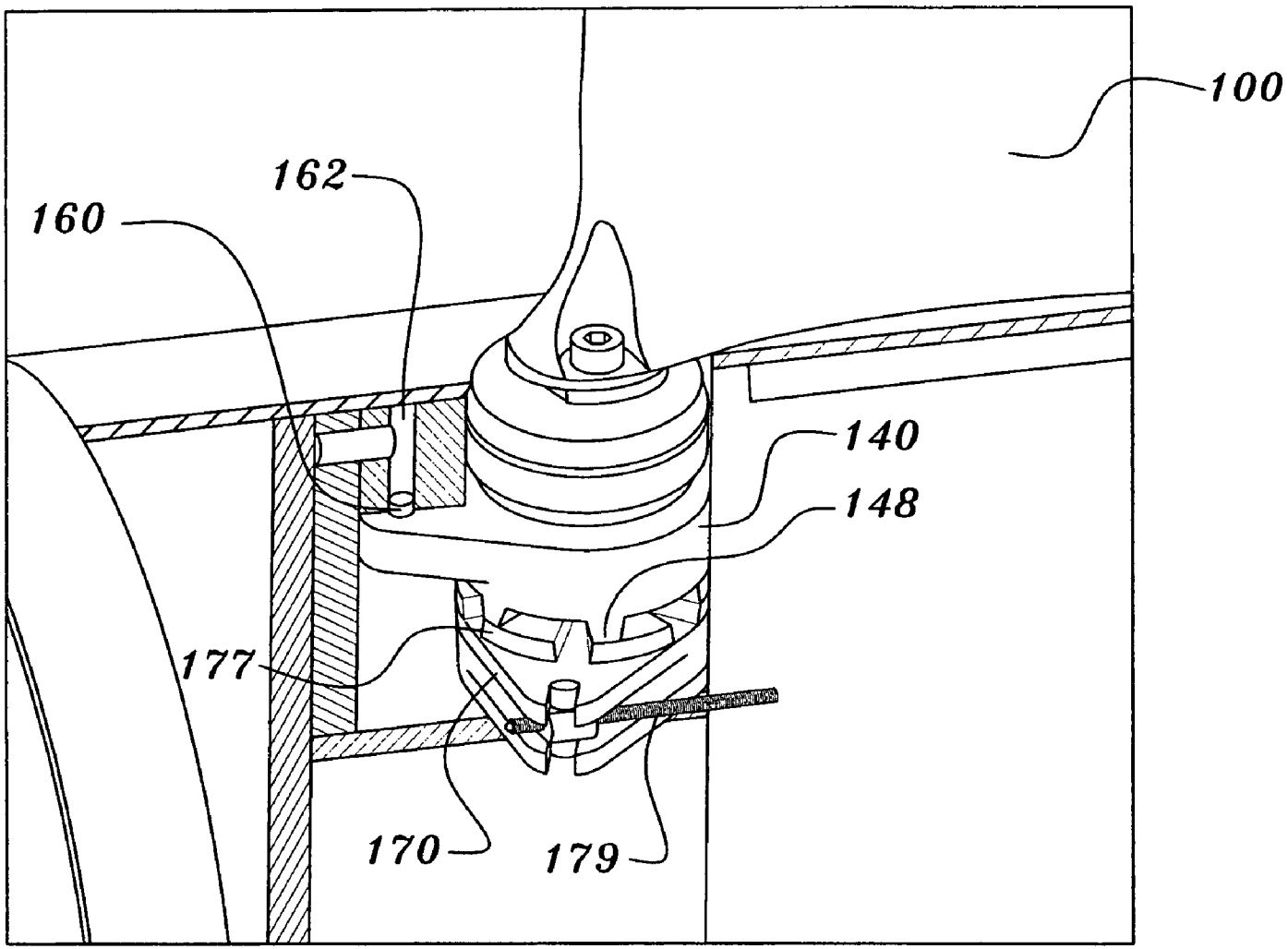
FIG. 2 illustrates an embodiment of the shaft lock device according to the present invention in a "storage" state.

FIG. 2 illustrates an embodiment of the present invention in the "storage" state. That is, slidable coupling 140 has not yet engaged with rotatable coupling 170. As shown in FIG. 2, during the "storage" state, engagement structure 146 and engagement structure 176 have not been mated. As such, teeth 148 and teeth 177 are resting against each other and slidable coupling 140 is inhibited from moving axially toward rotatable coupling 170. Additionally, axial rotation device 160 is engaged with selective axial engagement port 162 which prevents the axial rotation of slidable coupling 140 and, by connection to shaft 110, the axial rotation of fin 100. In FIG. 2, drive device 179 is a screw-threaded shaft. Thus, the selective shaft lock device of the present invention provides for a "storage" state in which fin 100 is locked in position.

Figure 3:
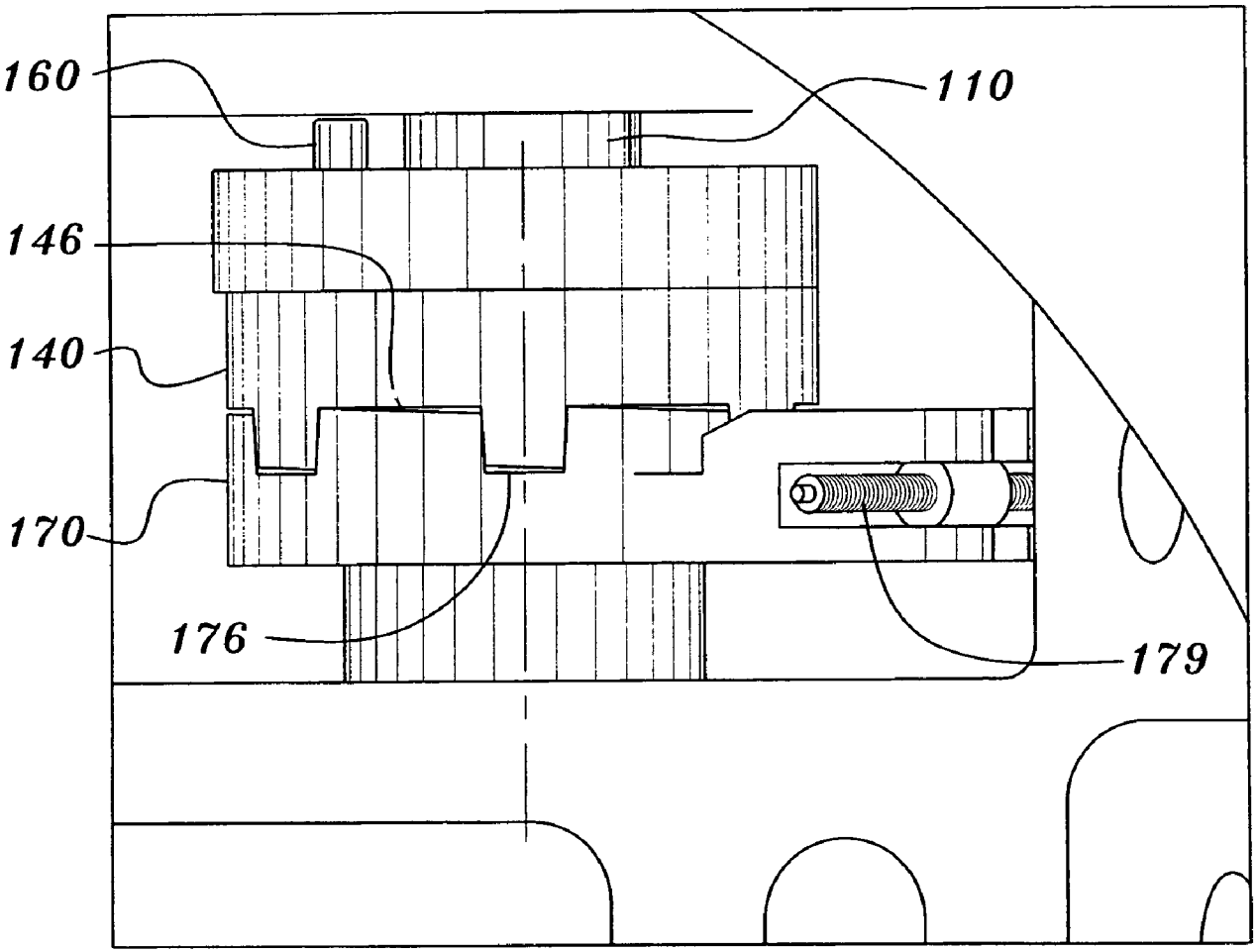
FIG. 3 illustrates an embodiment of the shaft lock device according to the present invention in an "in use" or "testing" state.

FIG. 3 illustrates the "in use" state of an embodiment of the present invention. According to the present invention, when it is desired to move from the "storage" state to the "in use" state, a force is applied to drive device 179. In the illustration of FIG. 3, an actuator (not shown) would rotate the screw-threaded shaft which comprises drive device 179. Such an application of force has the effect of axially rotating rotatable coupling 170 and moving engagement structure 176 into a position relative to engagement structure 146 such that the force applied by stored energy device 130 to slidable coupling 140 causes slidable coupling 140 to engage with rotatable coupling 170. As will be appreciated by one skilled in the art, the size and dimensions of engagement structure 146 and engagement structure 176 is preferably such that the minimum distance necessary for slidable coupling 140 to engage rotatable coupling 170 is greater than the distance selective axial rotation device 160 projects into selective axial engagement port 162. Thus, once slidable coupling 140 engages with rotatable coupling 170, rotatable coupling 170 is now free to rotate about shaft 110 and any force applied to rotatable coupling 170 via drive device 179 will act upon slidable coupling 140, and necessarily fin 100 given that both slidable coupling 140 and fin 100 are fixedly attached to shaft 110 (as shown in FIG. 1).

As would be appreciated by one skilled in the art, although the embodiments described herein illustrate a shaft lock device 10 in which slidable coupling 140 slides inward to engage with rotatable coupling 170, it is contemplated by the present invention to reverse the orientation of slidable coupling 140 and rotatable coupling 170. Configurations having slidable coupling 140 slide outward (relative to the missile, rocket, etc.) to engage with rotatable coupling 170 are specifically within the scope of the present invention. Further, embodiments mounting fixed energy device 130 against the internal structure of the missile, rocket, etc. as opposed to fixed buttress 120 and constructing the remainder of the shaft lock device of the present invention as taught herein are within the scope of this invention.

Figure 4:
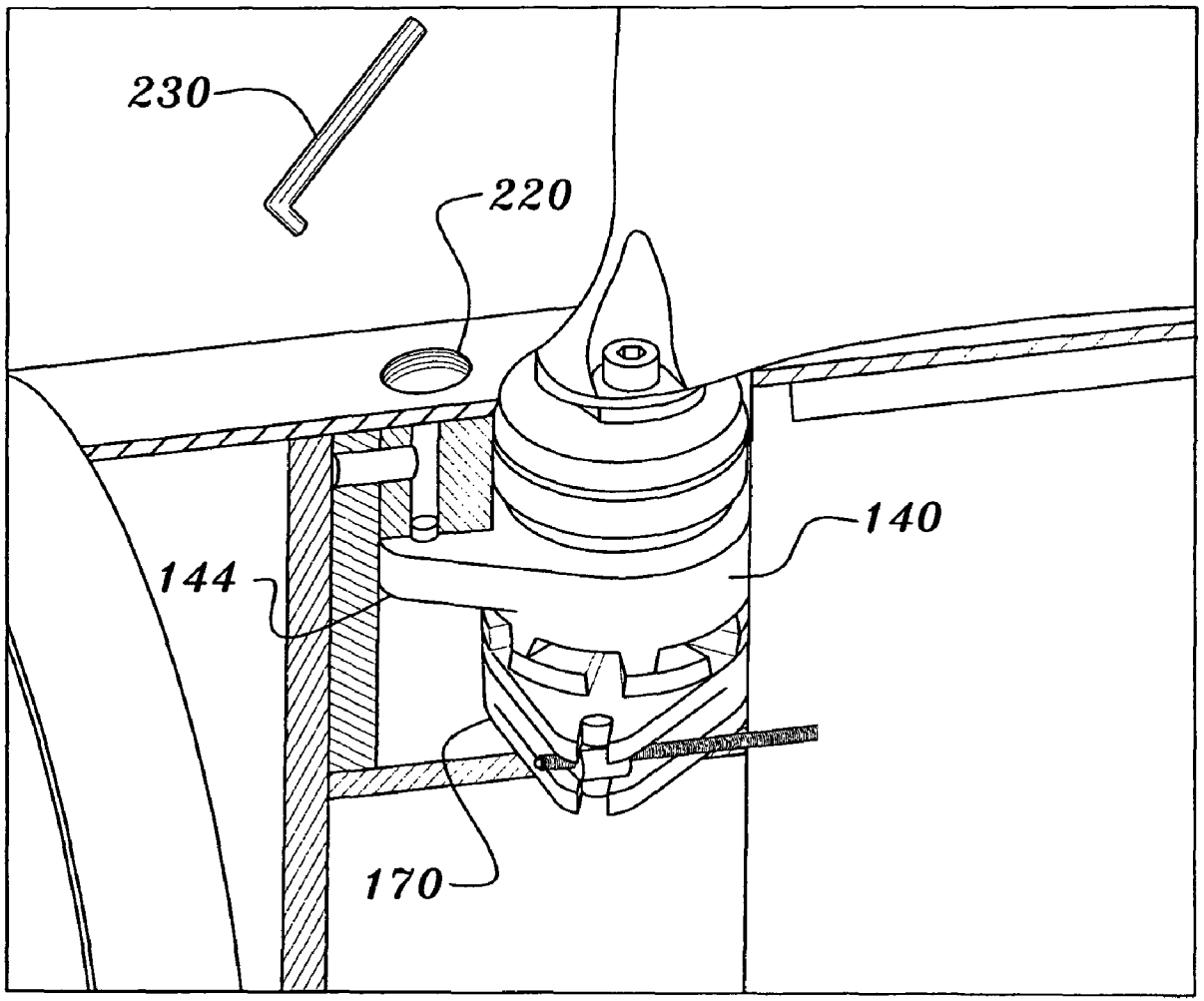
FIG. 4 illustrates an embodiment of the shaft lock device according to the present invention illustrating the use of a retraction device for bringing the shaft lock from an "in use" state to a "storage" state.

Referring to FIG. 4, it is further contemplated by the present invention to provide an access point 220 at a location in the vicinity of fin 100. Access point 220 can be either an open hole or a hole with a corresponding cover to maintain the aerodynamic profile of the missile, rocket, etc. In the embodiment illustrated in FIG. 4, access point 220 is a hole. Access point 220 permits the insertion of a retraction device 230 such as a hook, pliers, etc. In a preferred embodiment, retraction device 230 is an L-shaped tool. Retraction device 230 can be inserted into access point 220 and then engage with the second major surface 144 of slidable coupling 140. Once engaged, retraction device 230 can be used to disengage slidable coupling 140 from rotatable coupling 170. Once slidable coupling has been retracted a sufficient distance, actuator 200 can be operated to rotate rotatable coupling 170 into a position such that engagement structure 146 and engagement structure 176 are orientated in a "storage" fashion and unable to engage with each other (as illustrated in FIG. 2). Retraction device 230 can then be removed via access point 220 and the shaft lock device has been returned to the "storage" position.

It is understood that the above description is intended to be illustrative and not restrictive. Although various characteristics and advantages of certain embodiments of the present invention have been highlighted herein, many other embodiments will be apparent to those skilled in the art without deviating from the scope and spirit of the invention disclosed. The scope of the invention should therefore be determined with reference to the claims contained herewith as well as the full scope of equivalents to which said claims are entitled.

Now that the invention has been described,

What is claimed is:

1. A locking device comprising:

a shaft having a first and a second end;

a first coupling mechanism having a selectively engageable first major surface, said first coupling mechanism being rotateably mounted to said shaft;

a drive device operably connected to said first coupling mechanism;

a second coupling mechanism having a selectively engageable second major surface, said second coupling mechanism fixedly mounted to said shaft in the axial direction of said shaft and movably engaged along the longitudinal dimension of said shaft, said second coupling mechanism being disposed between said first coupling mechanism and said second end of said shaft;

a mounting surface, said mounting surface being fixedly engaged with said shaft, a rotation prevention device operably connected to said second coupling mechanism and said mounting surface; and a stored energy device disposed between said second coupling mechanism and said mounting surface;

wherein a force applied to said drive device causes axial rotation of the first coupling mechanism relative to the shaft such that the selectively engageable major surfaces of the coupling mechanisms align and are engaged by application of force from the stored energy device thereby disengaging the rotation prevention device and permitting the actuator to control axial rotation of the shaft; and wherein said locking device is coupled to an aerodynamic surface.

2. The locking device of claim 1 further comprising an actuator operably connected to said drive device.

3. The locking device of claim 1 wherein said second coupling device further contains a selective axial rotation device.

4. The locking device of claim 3 wherein said selectively engageable first major surface of said first coupling device contains at least one recessed surface.

5. The locking device of claim 4 wherein the majority of said selectively engageable first major surface of said first coupling device is recessed.

6. The locking device of claim 3 wherein said selectively engageable first major surface of said first coupling device contains a plurality of teeth.

7. The locking device of claim 6 wherein said selectively engageable second major surface of said second coupling device contains a plurality of teeth.

8. The locking device of claim 7 wherein the surface area of said plurality of teeth on said selectively engageable second major surface of said second coupling device is more than half of the total surface are of said selectively engageable second major surface.

9. The locking device of claim 8 wherein the top surface of said plurality of teeth on said selectively engageable first major surface of said first coupling device and said plurality of teeth on said selectively engageable second major surface of said second coupling device is angled.

10. The locking device of claim 3 wherein said first end of said shaft is operably connected to said aerodynamic control surface.

11. The locking device of claim 10 wherein said first end of said shaft is rotateably connected to an axial mounting device.

12. The locking device of claim 1 wherein said first coupling mechanism further contains one or more axial position sensors.

13. The locking device of claim 12 wherein said axial mounting device further contains at least one axial position locator.

14. The locking device of claim 13 wherein said axial mounting device is connected to a missile.

15. The locking device of claim 14 wherein said missile further contains a selective axial engagement port.

16. The locking device of claim 15 wherein said missile contains an access point for accessing said locking device.

17. The locking device of claim 13 wherein said axial mounting device is connected to an artillery projectile.

18. The locking device of claim 17 wherein said artillery projectile further contains a selective axial engagement port.

19. The locking device of claim 18 wherein said artillery projectile contains an access point for accessing said locking device.

20. The locking device of claim 13 wherein said axial mounting device is connected to a guided munition.

21. The locking device of claim 20 wherein said guided munition further contains a selective axial engagement port.

22. The locking device of claim 21 wherein said guided munition contains an access point for accessing said locking device.

23. A method of testing an aerodynamic surface prior to flight, said method comprising the steps of:

providing a locking device comprising a shaft having a first and a second end, an aerodynamic surface fixedly connected to said first end of said shaft, a first coupling mechanism having a selectively engageable first major surface, said first coupling mechanism being rotateably mounted to said shaft, a drive device operably connected to said first coupling mechanism, a second coupling mechanism having a selectively engageable second major surface, said second coupling mechanism fixedly mounted to said shaft in the axial direction of said shaft and movably engaged along the longitudinal dimension of said shaft, said second coupling mechanism being disposed between said first coupling mechanism and said second end of said shaft, a rotation prevention device operably connected to said second coupling mechanism, a mounting surface, said mounting surface being fixedly engaged with said shaft, and a stored energy device disposed between said second coupling mechanism and said mounting surface;

exerting a force against said drive device of said locking device such that said first coupling mechanism rotates about said shaft to a sufficient degree to cause said selectively engageable first major surface of said first coupling mechanism to engage with said selectively engageable second major surface of said second coupling mechanism; and verifying the control characteristics of said aerodynamic surface by correlating the operation of said drive device with the corresponding movements of said aerodynamic surface.

24. The method of claim 23 further comprising the steps of:

providing an access point through which said second coupling mechanism can be accessed;

inserting a retraction device into said access point;

retracting said second coupling mechanism with said retraction device; and exerting a force against said drive device of said locking device such that said first coupling mechanism rotates about said shaft to a sufficient degree to cause said selectively engageable first major surface of said first coupling mechanism to disengage with said selectively engageable second major surface of said second coupling mechanism.

* * * * *

UNITED STATES PATENT AND TRADEMARK OFFICE

CERTIFICATE OF CORRECTION

PATENT NO. : 8,030,603 B2
APPLICATION NO. : 12/422673
DATED : October 4, 2011
INVENTOR(S) : Richard W. Schroeder It is certified that error appears in the above-identified patent and that said Letters Patent is hereby corrected as shown below:

Column 1, line 3 "PRIORITY" should be deleted

Signed and Sealed this
Fifteenth Day of November, 2011

David J. Kappos

David J. Kappos
*Director of the United States Patent and Trademark Office*